US006726089B1

(12) United States Patent
Jones

(10) Patent No.: US 6,726,089 B1
(45) Date of Patent: Apr. 27, 2004

(54) PORTABLE MAILBOX COVER

(76) Inventor: Douglas Jones, 1303 Ocala Rd., Apt. 262, Tallahassee, FL (US) 32304

( * ) Notice: Subject to any disclaimer, the term of this patent is extended or adjusted under 35 U.S.C. 154(b) by 0 days.

(21) Appl. No.: 10/293,857

(22) Filed: Nov. 13, 2002

(51) Int. Cl.[7] ..... B65D 91/00
(52) U.S. Cl. ..... 232/38
(58) Field of Search ..... 232/38, 17; D99/29–32; 52/3

(56) References Cited

U.S. PATENT DOCUMENTS 5,035,356 A * 7/1991 Granger ..... 232/17
D348,969 S * 7/1994 Barbour ..... D99/30
D375,394 S * 11/1996 Hodges ..... D99/30
D376,250 S * 12/1996 Conley, Jr. ..... D99/30
D420,197 S * 2/2000 Arnold ..... D99/30
D421,327 S * 2/2000 Quick ..... D99/30
D456,978 S * 5/2002 Wajnerman et al. ..... D99/30
D458,002 S * 5/2002 Wajnerman et al. ..... D99/30
D458,726 S * 6/2002 Wajnerman et al. ..... D99/30
6,619,541 B2 * 9/2003 Martin et al. ..... 232/38

* cited by examiner

*Primary Examiner*—William L. Miller

(57) ABSTRACT

A mailbox cover featuring a three-dimensional object or structure secured thereto is disclosed. The use of three-dimension object being secured to a mailbox will provide for an overall product that adds to the aesthetic appeal of an ordinary product. The object includes a front portion that is secured to the lid of a mailbox and a rear portion that is secured to the back of a mailbox. Each portion is secured via a conventional attaching device. Alternatively, a base can be used to secure the second portion to the mailbox. This will provide for the secure portion to be removably secured to the base and thus enable interchangeable objects to be placed on the base and ultimately on the mailbox.

13 Claims, 6 Drawing Sheets

PORTABLE MAILBOX COVER

BACKGROUND OF THE INVENTION

1. Field of the Invention

The present invention relates generally to a portable mailbox cover and more particularly to a portable mailbox cover featuring a three dimensional object, preferably an object representing a sport or a particular collegiate or professional athletic team, for adding aesthetic appeal to a mailbox while providing support for the particular sporting event or team.

2. Description of the Prior Art

One of the major problems with mailboxes is that they are permanently installed and often lack an attractive appearance. For example, U.S. Pat. No. 5,435,484 features a mailbox formed by an upright hollow housing closed by a top door and having a trap door intermediate with its height separating the hollow housing into an upper compartment and a lower compartment. This mailbox has the appearance of a large square trashcan with a top lid and an intermediate trap door.

U.S. Pat. No. 5,351,883 comprises a mail access section large enough to receive and support letters and packages. A mail containment section supports the access section above the ground and receives the mail as it is inserted through the access section. This mailbox has a standard everyday mailbox appearance and would not be an enhancement to the neighborhood.

The present invention features not only portability but also a very attractive appearance and an enhancement for every neighborhood. For these reasons it is seen that the previous efforts do not provide the benefits intended with the present invention. Additionally, prior techniques do not suggest the present inventive combination of component elements as disclosed and claimed herein. The present invention achieves its intended purposes, objectives and advantages over the prior art through a new, useful, and unobvious combination of component elements, which is simple to use, with the utilization of a minimum number of functioning parts, at a reasonable cost to manufacture, assemble, test and by employing only readily available material.

The foregoing has outlined some of the more pertinent objects of the invention. These objects should be constructed to be merely illustrative of some of the more prominent features and application of the intended invention. Many other beneficial results can be obtained by applying the disclosed invention in a different or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

SUMMARY OF THE INVENTION

The present invention is a mailbox cover featuring a three-dimensional object or structure secured thereto. The use of three-dimension object being secured to a mailbox will provide for an overall product that adds to the aesthetic appeal of an ordinary product.

In the first embodiment of the present invention, the cover comprises a three-dimensional object or structure having an attaching device secured thereto. This will provide for the object to be secured to a conventional mailbox via the attaching device.

For a more permanent attachment to the conventional mailbox, bolts or the like can be used as the attaching device. In this arrangement, holes are tapped into the existing mailbox; the bolts are inserted therein and secured interiorly to the mailbox by-way of nuts, wing nuts or the like.

To provide for a portable unit, a strap can be used as an attaching device. In this arrangement, a strap would be located on one side of the three dimensional object or structure, while a securing unit for accepting the strap is located on the opposite side of the three dimensional object. This will provide for the strap to wrap under the conventional mailbox and enable the three dimensional object to be secured thereto. The use of the strap provides an adjustable system, which enables the mailbox cover to be installed over an existing regular mailbox, quickly and easily. It is noted that the use of zip ties has utilized to produce favorably results.

In an alternative arrangement, a base can be provided. This base will include two separate types of attaching devices. The first attaching device will be adapted to removably receive the three dimensional object, while the second attaching device will be allow attachment of the base to the conventional mailbox. Such an arrangement provides for a unit that provides interchangeable objects, and thus permits for the user to change to any desired object, such as enabling a snowman for winter, a pumpkin for the fall, the American flag for the summer, and a football helmet of a particular team during homecoming.

This ornamental structure is designed and depicted so as to add interest and versatility to the overall product. Accordingly, this ornamental structure can represent any sporting event, such as, but not limited to collegiate, professional, or amateur football; collegiate, professional, or amateur basketball; collegiate, professional, or amateur baseball; collegiate, professional, or amateur hockey; collegiate, professional, or amateur soccer; collegiate, professional, or amateur auto racing; collegiate, professional, or amateur wrestling; collegiate, professional, or amateur golfing; animals; famous and well known figurines, characters, animated objects; seasonal items, or the like. By way of example, if the mailbox owner is a football fan, the top portion of the container could be shaped as a football or optionally as a helmet, sporting the name and logo of the owner's favorite team on the sidewall. This unique arrangement is unlimited in design structure by enabling any desirable structure to be secured to the conventional mailbox.

Accordingly, it is an object of the present invention to provide for a mailbox cover which will overcome the deficiencies, shortcomings and drawbacks of prior mailbox covers and methods thereof.

Another object of the present invention is to provide the user the opportunity to publicly support his sporting interest, personal interest, and seasonal display opportunities.

Still another object of the present invention is to enhance the appearance of the neighborhood due to the pleasant and eye-catching appearance of the portable mailbox cover.

Yet another object of the instant invention is to provide for portability and interchangeability of various mailbox covers.

Although there have been other inventions related to mailbox covers, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
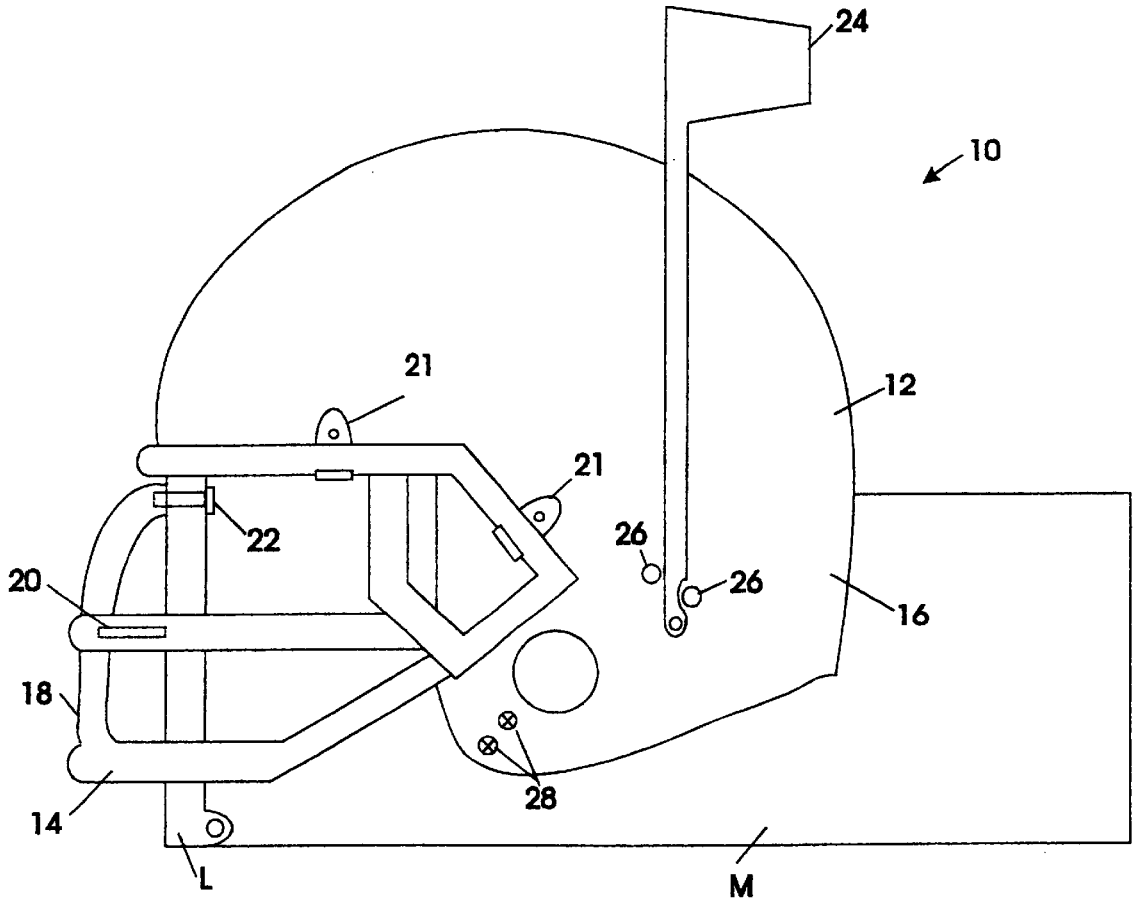
FIG. 1 is a side planar view of the mailbox cover device of the present invention, illustrating a sporting theme for the three-dimensional object and being secured via a first attaching device.

The present invention, shown in FIG. 1–FIG. 4, is a mailbox cover apparatus, generally denoted by reference numeral 10 and is designed and configured to be used and secured to conventional mailboxes. By conventional mailboxes, it is to be understood that these are standard, U.S. Postal Service approved mailboxes.

The object of the present invention is to enable the mailbox to function in its intended and normal state, as well as provide for a product that is aesthetically pleasing. Ultimately providing for a device which is not obtrusive when placing items in or out of the conventional mailbox.

Figure 3A:
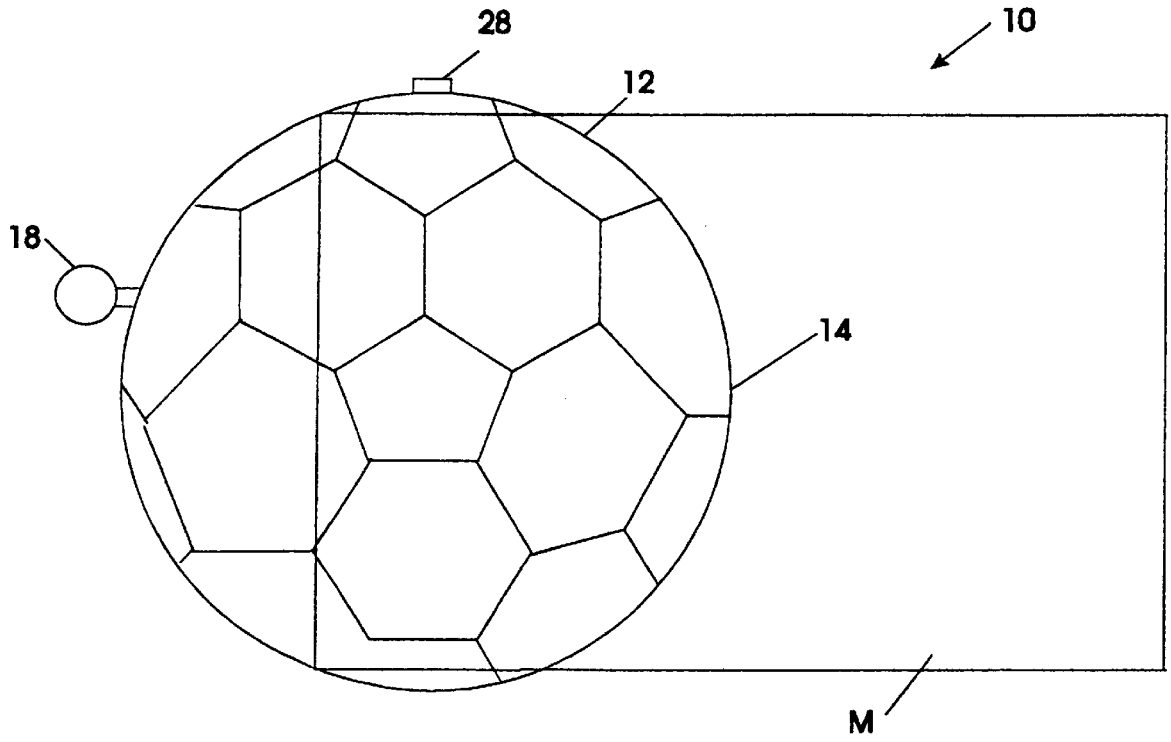
FIG. 3*a* is a side planar view of the mailbox cover device of the present invention, illustrating an alternative three-dimensional objected secured thereto.

As seen in the FIG. 1 and FIG. 3*a* the apparatus of the present invention 10 comprises an ornamental three-dimensional object 12 that will be secured to a conventional mailbox M. The three dimensional object 12 includes two portions. The two portions comprises a front or first portion 14 which is to be secured to the lid of the mailbox and a rear or second portion 16, which is to be secured to the housing portion of the conventional mailbox. This will provide for the ornamental object to appear to be continuous and non-disruptive.

The front portion 14 and rear portion 16, combined, will give the appearance of a singular three-dimensional object or structure. The front portion 14 will be secured to the lid and thus will have a handle 18 for enabling access to the interior of the mailbox. The handle 18 can be an integral component of the object, as seen in FIG. 1 or can be a separate member of the object as seen in FIG. 3*a*.

In FIG. 1, the mask will act as the handle, and when a user pulls down on the mask (handle), the lid L of the conventional mailbox will be lowered, thus rendering access therein. A handle can be added as seen in FIG. 3*a*, and thus protrudes out from the front of the three dimensional object.

The unique nature of the present invention enables any type or style object to be used. As seen in FIG. 1, since the object is three dimensional, the front portion may protrude outwardly. To accommodate this protrusion, at least one support rod 20 (illustrated in outlined) is used to secure the front portion 14 of the object to the lid. This support rod 20 is secured to the front portion of the object and is secured to the lid L of the conventional mailbox via conventional attaching means 22, such as the use of a bolt and nut, or the like. Other conventional securing devices, such as adhesives, or the like, can be used. For added security, other areas contacting the outer surface of the lid can be secured to the lid via conventional devices as discussed above.

Figure 3B:
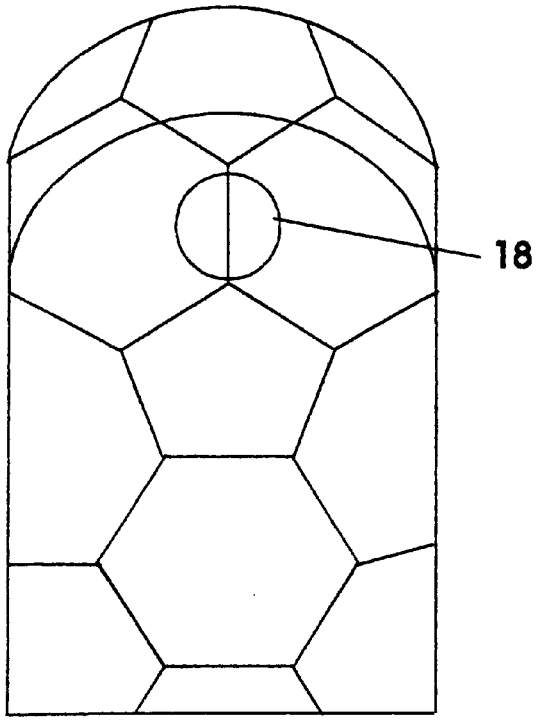
FIG. 3*b* is a front planar view of the mailbox cover device of the present invention, illustrating the front portion of the three-dimensional object secured to the lid of the present invention.
Figure 3C:
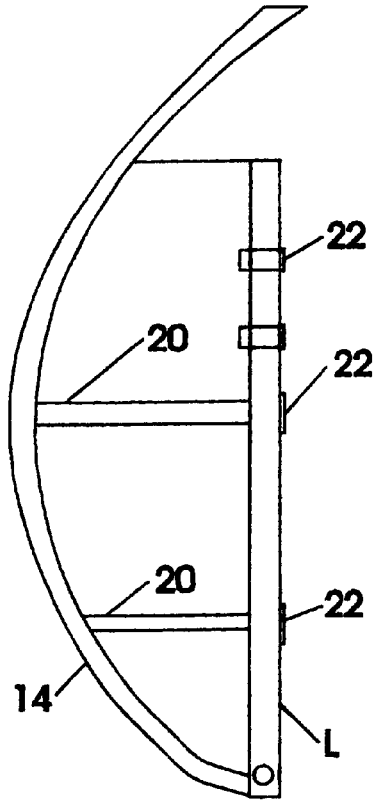
FIG. 3*c* is a cross-sectional view of first portion of the mailbox cover device secured to the lid of a conventional mailbox.

As seen in FIGS. 3*b* and 3*c* the front portion is a more substantial unit, and it includes two support rods 20 that are used for supporting the overall structure of the front portion of the object, as well as enable the front portion 14 to be secured to the lid L of the mailbox. This particular first portion is solid and can include additional attaching devices 22 for allowing attachment to occur successfully. The attaching devices 22 can be any conventional attaching devices as discussed above.

Figure 2:
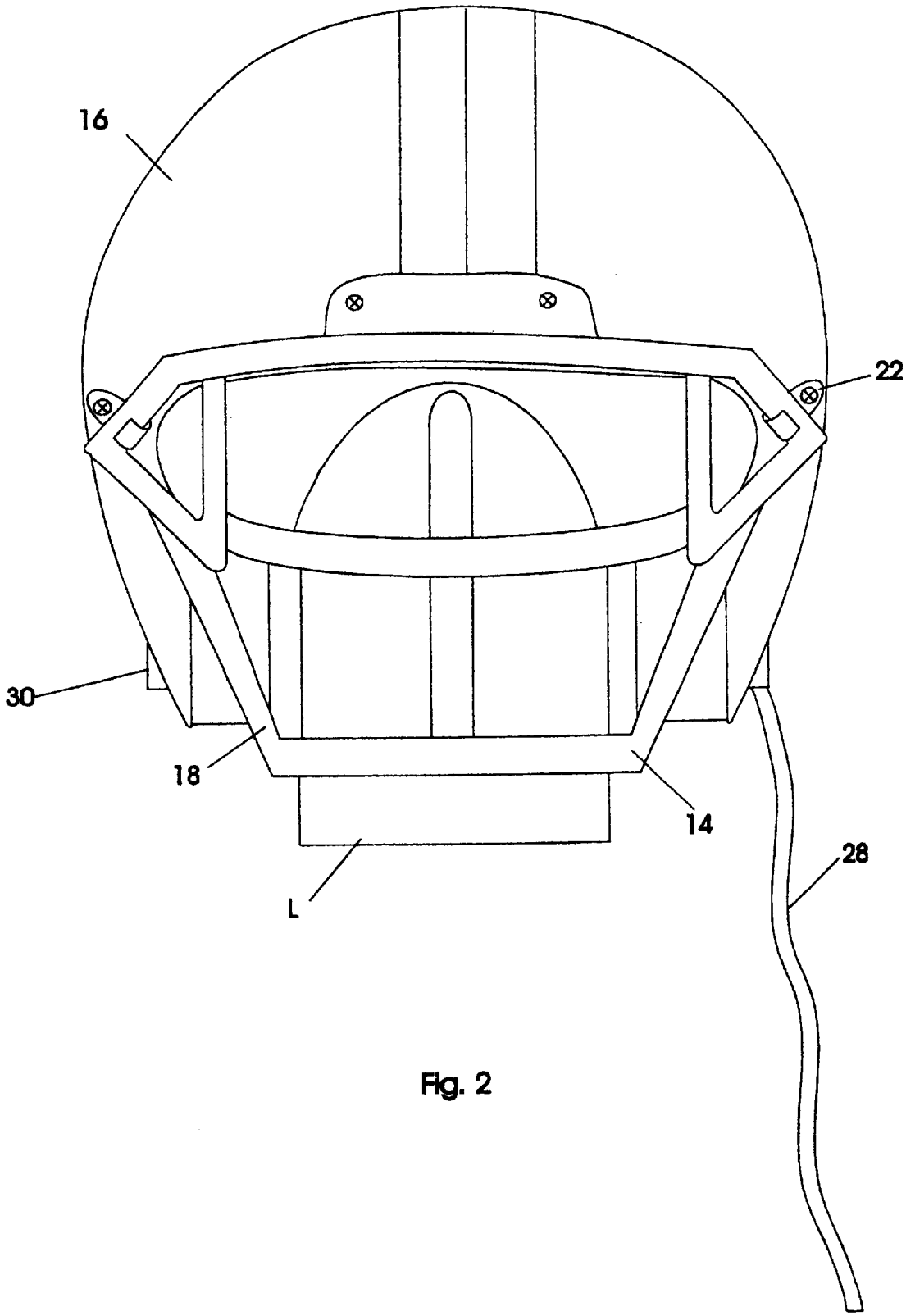
FIG. 2 is a front planar view of the mailbox cover device of the present invention, illustrating a sporting theme for the three dimensional object and being secured via a second attaching device for producing a portable attaching device.

Since the use of the object may add additional weight to the lid, closure units can be used to ensure closure of the lid of the mailbox when desired. As seen in FIGS. 1 and 2, hooks 21 are attached to the second portion 16 of the object. The first portion is received within these hooks, thus allowing for the lid to be snapped into a closed and locked position when desired, yet permit easy access to the interior by merely gently pulling on the handle 18. Other conventional closures can be used and can be secured interioraly within the interior section of the conventional mailbox.

The second portion of the object 12 is hollow and thus will engulf and receive the top and side surfaces of the conventional mailbox, as seen in FIGS. 1, 2 and 3*a*. This hollow portion can include a conventional flag 24, as shown in FIG. 1, for indication mail is located therein. The flag is pivotally secured to the second portion and stops 26 can be used to prevent the flag from extending too far during pivotal rotation.

This hollow second portion can include supports, though not illustrated, for added structural stability to the overall construction of the three dimensional object 12. Also included on this second portion is a second attaching device used for attaching the second portion to the conventional mailbox.

The attaching device can be any conventional attaching device. Preferably, and what has proven successful, is the used of nuts and bolts, or the like, for attaching the second portion to the conventional mailbox M. This arrangement is more permanent and is shown in FIGS. 1 and 3*a*. As seen in this figure the second attaching devices 28 provides for a more permanent attachment. In order to accomplish this type of attachment, holes are tapped through the existing mailbox. The holes can be either located on the top and/or side(s) of the mailbox. Holes will be provided within the second portion.

Once the holes are located through the mailbox M, the holes are aligned with the holes from the second portion 12. Once aligned, the securing device (such as a bolt) is inserted therein and secured via a nut, wing nut or the like.

Another example of attaching the second portion to the existing mailbox is the use of straps. This method will prevent the mailbox owner from tapping holes, and thus provides for a more convenient means of attachment, as well as a portable means of attachment. This type of attachment is illustrated in FIG. 2. As seen in this figure, a strap 28 would be located on one side of the three dimensional object or structure, while a securing unit 30 for accepting the strap is located on the opposite side of the three dimensional object. This will provide for the strap to wrap under the conventional mailbox and enable the three dimensional object to be secured thereto. The use of the strap provides an adjustable system, which enables the mailbox cover to be installed over an existing regular mailbox, quickly and easily. It is noted that the use of conventional zip ties has been utilized to produce favorably results. In the case of zip ties, at least two were coupled together for providing the adequate amount of length for strapping and securing the second portion 16 to the conventional mailbox.

Figure 4:
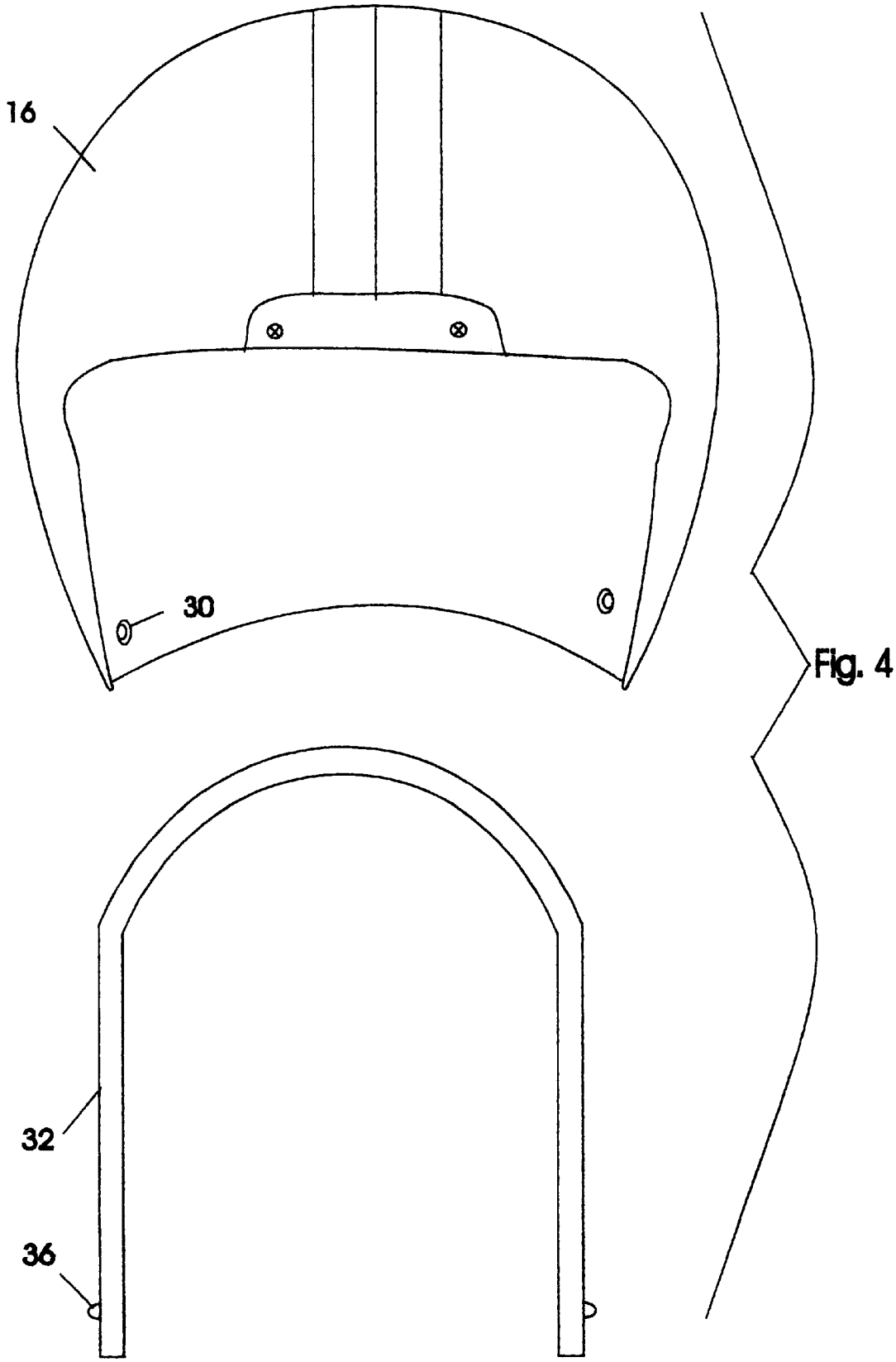
FIG. 4 is an exploded view of the second embodiment of the present invention, illustrating a base used to removably receive a three dimensional object.

Alternatively, the objects 12 can be designed and configured to be interchangeable. In this configuration the use can change the object whenever desired and thus provide for a plurality of covers to be utilized. For the interchangeable configuration, a base 32, as seen in FIG. 4, is used. This base 32 has substantially the same cross-sectional shape as a conventional mailbox, and thus will provide for a snug fit when secured thereto. This base is fabricated from a durable, yet flexible material, such as, but not limited to, metal, plastic or the like.

Removably secured to the base 32 is the second portion 16 of the object 12. To allow for removable securement, the base includes a conventional securing device 34 externally located. A corresponding securing device 36 is secured interiorly in the second portion. This will provide for the second portion to be secured to the base via the securing device. The securing device can be any conventional securing device, such as, but not limited to snaps, VELCRO, bolts, threaded members, or the like.

Figure 5:
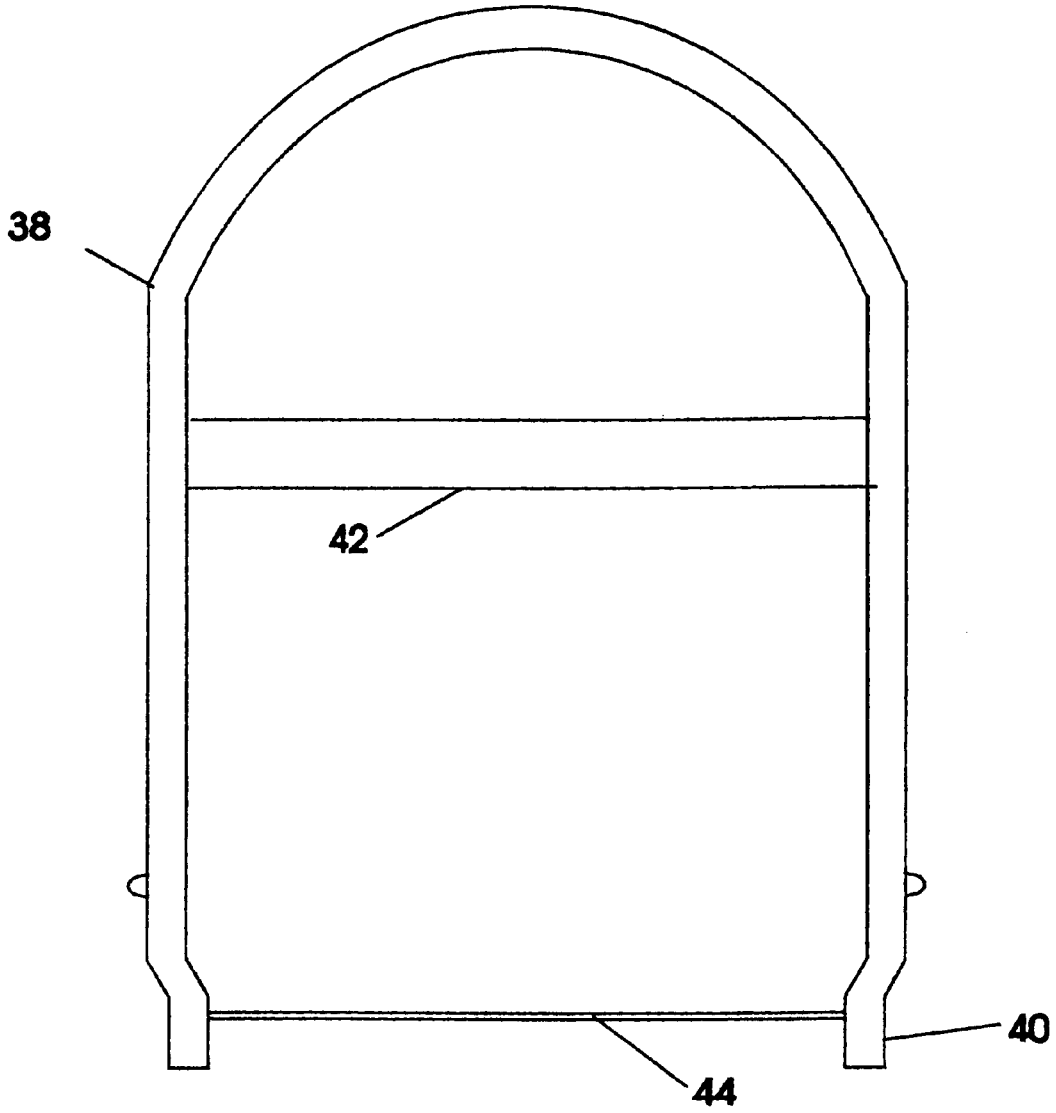
FIG. 5 is a front view of an alternative construction of the base used in the second embodiment of the present invention.

The base can be altered to provide for a more secure fit on the conventional mailbox. This alteration is shown in FIG. 5. As seen, the base includes an upper portion 38 and a lower portion 40. The upper portion is substantially the same as disclosed in FIG. 4. The lower portion extends slightly inward and when attached to a conventional mailbox will be located under the base of the mailbox. This arrangement will prevent the base from dislodging from the conventional mailbox.

Additional features can be added to the base illustrated in FIG. 4 or 5, such as a support 42 or an additional attaching device 44, such as a strap. These features will add structural stability to the cover when secured to a conventional mailbox.

This ornamental structure is designed and depicted so as to add interest and versatility to the overall product. Accordingly, this ornamental structure can represent any sporting event, such as, but not limited to collegiate, professional, or amateur football; collegiate, professional, or amateur basketball; collegiate, professional, or amateur baseball; collegiate, professional, or amateur hockey; collegiate, professional, or amateur soccer; collegiate, professional, or amateur auto racing; collegiate, professional, or amateur wrestling; collegiate, professional, or amateur golfing; animals; famous and well known figurines, characters, animated objects; seasonal items, or the like. By way of example, if the mailbox owner is a football fan, the top portion of the container could be shaped as a football or optionally as a helmet, sporting the name and logo of the owner's favorite team on the sidewall. This unique arrangement is unlimited in design structure by enabling any desirable structure to be secured to the conventional mailbox.

While the invention has been particularly shown and described with reference to an embodiment thereof, it will be understood by those skilled in the art that various changes in form and detail may be made without departing from the spirit and scope of the invention.

I claim:

1. A mailbox cover for a mailbox having a lid, comprising:

a three-dimensional object having a front portion and a rear portion;

said front portion being adapted to be removably secured to said mailbox lid and said rear portion being adapted to be removably secured to said mailbox;

said front portion includes a first attaching device for attaching said front portion to said lid; and said rear portion includes a second attaching device for attaching said rear portion to said mailbox;

and wherein a base is located between said rear portion and said second attaching device, said second attaching device secures said three-dimensional object to said base and a securing device secures said base to said mailbox.

2. A mail box cover as in claim 1 wherein a closure is secured to said rear portion for enabling said lid to snap closed when desired.

3. A mail box cover as in claim 1 wherein said first attaching device is nuts and bolts, said bolts extend through said front portion and said lid and is secured via said nuts.

4. A mailbox cover as in claim 1 wherein said second attaching device is nuts and bolts, said bolts extend through said rear portion and said mailbox and is secured via said nuts.

5. A mailbox cover as in claim 1 wherein said second attaching device is a strap.

6. A mailbox cover as in claim 1 wherein a support is located on said base for providing structural support.

7. A mailbox cover as in claim 1 wherein said front portion includes a handle.

8. A mailbox cover as in claim 1 wherein said rear portion includes a flag pivotally secured thereto.

9. A mailbox cover as in claim 8 wherein stops are located in proximity to said flag for prevention of said flag from extending too far during pivotal rotation.

10. A mailbox cover as in claim 1 wherein said rear portion is hollow.

11. A mailbox cover as in claim 1 wherein said base includes a lower portion and an upper portion, said upper portion is substantially sized according to said mailbox, said lower portion is sized smaller than said upper portion, said base is fabricated from a durable and flexible material for enabling said base to wrap around said mailbox.

12. A mailbox cover as in claim 1 wherein at least two three-dimensional objects are removably secured to said base.

13. A mailbox cover as in claim 1 wherein at least two three-dimensional objects are removably secured to said base and said lid.

* * * * *